United States Patent [19]

Sloan

[11] 4,373,860

[45] Feb. 15, 1983

[54] SUBMERSIBLE HYDRAULIC PUMP OF THE AXIALLY DIRECTED INLET AND TANGENTIAL OUTLET TYPE

[76] Inventor: Albert H. Sloan, 4200 Kean Rd., Fort Lauderdale, Fla. 33314

[21] Appl. No.: 291,889

[22] Filed: Dec. 24, 1980

[51] Int. Cl.[3] ..... F04D 1/00

[52] U.S. Cl. ..... 415/185; 415/183; 415/206; 415/219 C

[58] Field of Search ..... 415/183, 185, 203, 206, 415/204, 219 C

[56] References Cited

U.S. PATENT DOCUMENTS

| | | | |
|---|---|---|---|
| 292,122 | 1/1884 | Lee | 415/206 |
| 1,972,865 | 9/1934 | Broughton et al. | 415/206 |
| 2,312,422 | 3/1943 | Kumlin et al. | 415/204 X |
| 2,340,166 | 1/1944 | Young et al. | 415/183 X |
| 2,933,045 | 4/1960 | Isserlis | 415/183 X |
| 2,999,628 | 9/1961 | Crombie | 415/204 X |
| 3,708,239 | 1/1973 | Stahle | 415/206 |
| 3,824,042 | 7/1974 | Barnes et al. | 415/204 X |
| 4,224,009 | 9/1980 | Grandi | 415/169 A X |

FOREIGN PATENT DOCUMENTS

| | | | |
|---|---|---|---|
| 863235 | 1/1941 | France | 415/204 |

*Primary Examiner*—Philip R. Coe
*Assistant Examiner*—Frankie L. Stinson
*Attorney, Agent, or Firm*—James E. Nilles

[57] ABSTRACT

A submersible pump assembly having a volute casing in which a pump impeller is rotatably driven from a power source located outside the pump casing. The scroll-type casing has an axially directed inlet and tangential outlet. A drive shaft connects the power source with the radial flow impeller and a support bearing for the drive shaft is located at one side and centrally of the casing. The water inlet for the pump casing is located co-axially with the axis of the impeller at one side of the pump casing. The water flowing in an axial direction into the pump casing forms a vortex around the shaft bearing to create a minimum pressure zone around the bearing.

9 Claims, 5 Drawing Figures

SUBMERSIBLE HYDRAULIC PUMP OF THE AXIALLY DIRECTED INLET AND TANGENTIAL OUTLET TYPE

BACKGROUND OF THE INVENTION

This invention relates to submersible pumps of the type shown generally in the U.S. Pat. Nos. 4,224,008 issued Sept. 23, 1980 or 4,224,009 of Sept. 23, 1980 or 3,936,225 issued Feb. 3, 1976.

These and other prior art structures have axially infeed water inlets at the side of their volute casing which is opposite to the casing side where the impeller shaft bearing is located. As a result, these pumps have sealing problems because the shaft seal between the power source and the pump impeller is located in a water pressurized zone thereby causing leakage of water into the bearing assembly area.

SUMMARY OF THE PRESENT INVENTION

The present invention provides a submersible pump assembly having a volute casing and a pump impeller is rotatably driven from a power source located outside the pumping casing. The scroll or volute type casing has an axially directed water inlet and a tangential outlet. A drive shaft connects the power source with the radial flow impeller and a support bearing for the drive shaft is located at one side and centrally of the casing. The water inlet for the pump casing is located co-axially with the axis of the impeller at one side of the pump casing. The water flows in an axially direction into the pump casing and forms a vortex around the bearing shaft to create a substantially pressure-free zone around the bearing.

The submerged pump assembly provided by the present invention furthermore prevents the pump from digging itself downwardly and burying itself in the water bed. In other words, the present assembly has its suction inlet side located above the pump so that the pump does suck itself down into the water bed. Furthermore the present pump assembly is easy to assemble and disassemble for purposes of repair or other maintenance.

There and other objects and advantages of the present invention will appear hereinafter as this disclosure progresses, reference being had to the accompanying drawings.

DESCRIPTION OF A PREFERRED EMBODIMENT

Figure 2:
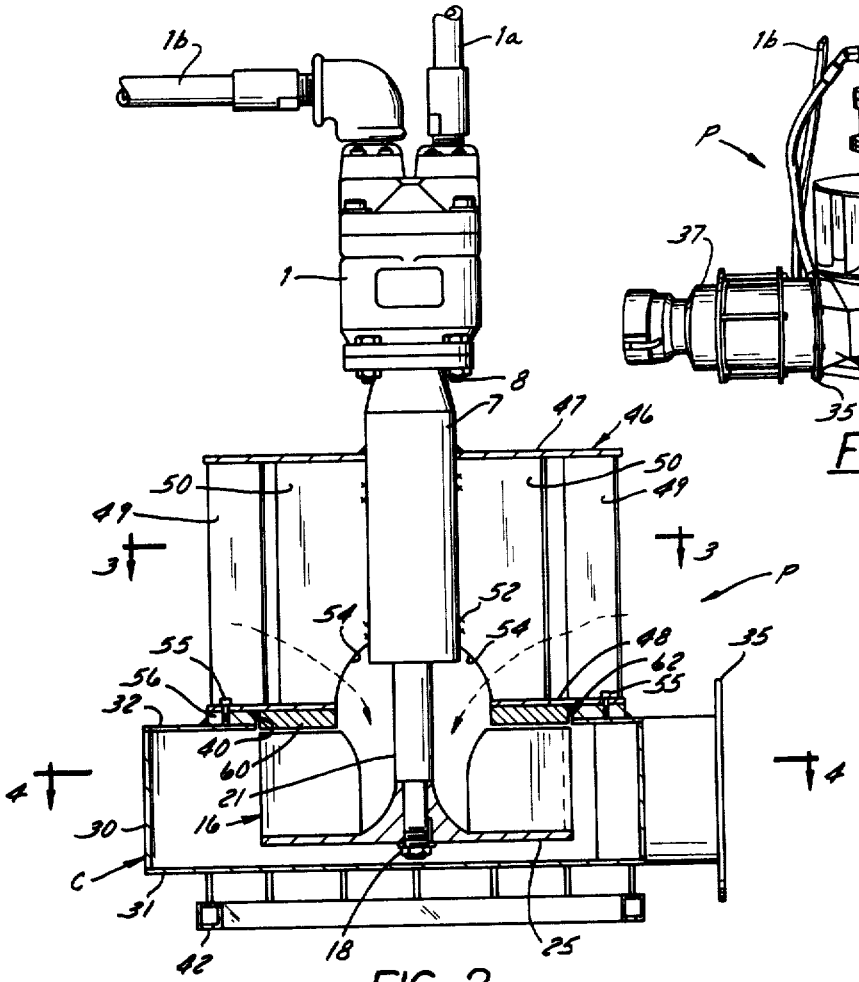
FIG. 2 is a vertical sectional view through the pump assembly shown in FIG. 1 but on an enlarged scale, and with certain parts shown as being removed for the sake of clarity in the drawings.

The present invention has been shown as being driven by a hydraulic motor 1 having a pressure fluid inlet conduit 1*a* and a return conduit 1*b*. The structure and operation of such a hydraulic motor and its associated components are shown and described in my U.S. Pat. No. 3,957,402 of May 18, 1976, and reference may be had to that patent if deemed necessary or desirable. However, it should be understood that the power source for driving the pump of the present invention can also be other means, such as an electric motor.

The hydraulic motor has an output shaft 2 (FIG. 5) which is drivingly connected by a keyed sleeve 3 to the drive shaft 4 of the pump. This drive shaft 4 is mounted in antifriction bearing assemblies 6 in the bearing housing 7 which is fixed by bolt means 8 to the motor 1.

Figure 5:
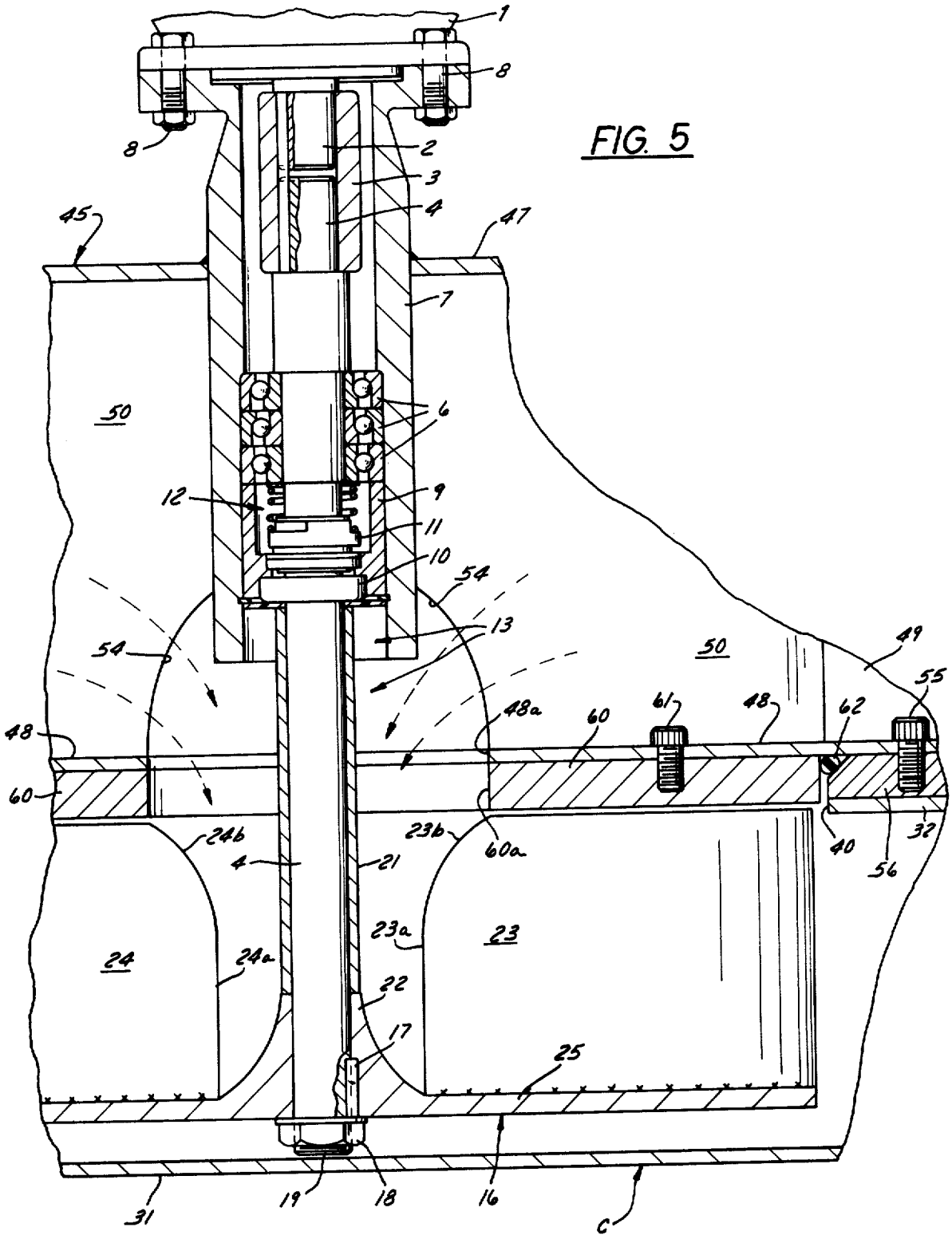
FIG. 5 is a fragmentary, vertical cross sectional view of a portion of the pump as shown in FIG. 2, but on an enlarged scale.

The seal assembly shown in FIG. 5 includes a cylindrical seal holder 9, flexible seal 10 and a mechanical fluid seal 11. This seal assembly is fully shown and described in my U.S. Pat. No. 3,957,403 issued May 18, 1976 entitled "Dewatering Pump Assembly." It is believed sufficient to say for purposes of this disclosure that the inner chamber 12 of the bearing assembly is pressurized with lubricating oil which prevents the in-flow of water past the seals and into the chamber 12. As will appear, with the present invention, the construction and complexity of the sealing arrangement is not as important as in the prior art structures shown in my said patents, and instead it is possible to use relatively simple and inexpensive seals in this area to prevent the in-flow of water into the bearings. This is possible because of the provision of the substantially pressure free zone indicated generally by numeral 13 in FIG. 5, as will appear.

A hydraulic pump P is provided having a rotor or impeller 16, commonly referred to as a runner, secured to the lower end of the shaft 4 by means of key 17 and nut 18 threadably engaged on the threaded end 19 of the shaft. An adjusting sleeve 21 is also mounted on the shaft 4 and abuts against the hub 22 of the vaned pump impeller 16. The impeller 16 includes two curved blades 23 and 24 which are secured to its bottom plate 25. It will be noted that the radial inner ends of blade 23 and 24 terminate short of the hub 22 as at 23*a* and 24*a*, respectively. Furthermore, the upper inner corners 23*b* and 24*b* are rounded or cut away. This construction permits water to flow readily into the pump without causing water pressure build up in that zone, for purposes that will more fully appear hereinafter.

Figure 1:
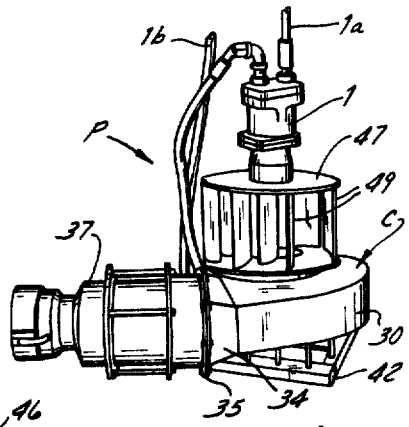
FIG. 1 is a perspective view of a submersible pump assembly made in accordance with the present invention.
Figure 3:
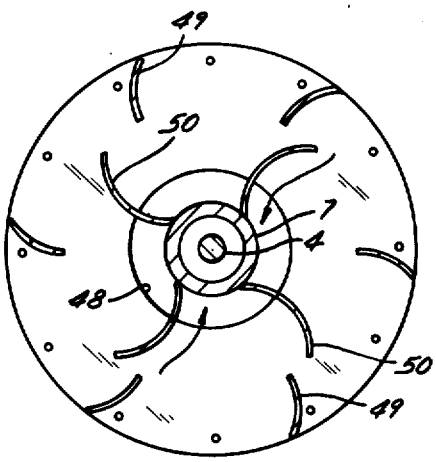
FIG. 3 is a horizontal, sectional view taken generally along the line 3—3 in FIG. 2.
Figure 4:
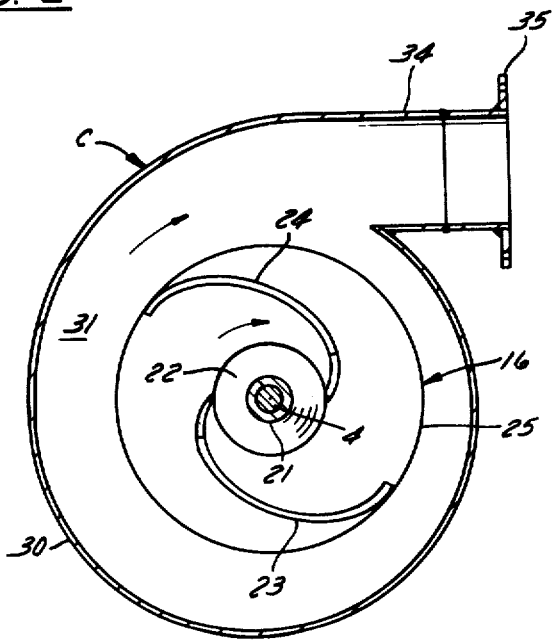
FIG. 4 is a horizontal sectional view taken along the line 4—4 in FIG. 2.

The pump P also includes a volute casing C of generally cylindrical shape and having an outer volute wall 30 together with a bottom wall 31 and a top wall 32 define a chamber in which the pump impeller 16 rotates. A generally tangential tubular outlet 34 extends from the casing and has a flange 35 to which a discharge pipe apparatus 37 (FIG. 1) may be attached. The top wall 32 has a central opening 40 in which a wear plate, to be described, is removably mounted, and through which the shaft 4 and tubular sleeve 21 extend and also through which the water is introduced into the pump casing in a generally vortex or whirlpool pattern as indicated by the dotted lines in FIG. 5, and as will more fully appear.

Secured to the bottom wall 31 of the pump assembly is a conventional heat exchanger 42 which may be of the type shown in my U.S. Pat. No. 3,957,402, granted May 18, 1976.

A water diffuser unit in the form of a water vortex generator 45 includes a frame 46 having an upper plate 47 and a vertically spaced apart lower plate 48 having central opening 48*a*. Between the plates 47 and 48 are a series of curved radially outer vanes 49 and a series of curved radially inner vanes 50, the inner edges of vanes 50 being welded as at 52 to the bearing housing 7. Vanes 49 and 50 are also welded at their upper and lower ends to plates 47 and 48, respectively, thus forming a particularly strong and rigid water vortex generator. The inner, lower corners of plates 50 are cut away as at 54 to provide free passage of water into the casing. The generator is secured by bolt means 55 to a mounting ring 56 which is welded to the top wall 32 of the pump casing. A steel wear ring 60 having a central opening 60*a* is secured by bolts 61 to the underside of plate 48. The plate-like wear ring 60 is easily replaceable by removing bolts 61 so that the space between the impeller blades and the wear ring can be maintained at an optimum distance. The wear ring can be shimmed or replaced by another wear ring when it becomes worn or otherwise rendered useless. It will be noted that the wear ring is fixed to the same structure containing the shaft supporting bearings, the bearing housing and the impeller structure and can be easily removed therewith. The bearing ring is not located in the volute casing itself and therefore the adjustment of the impeller relative to the wear ring is accomplished outside of the pump casing. This eliminates the prior art method of assembly, measurement of clearances, disassembly, the addition of shims or gaskets and other operations. The present structure insures concentricity and proper alignment between the parts.

The central openings in the bottom plate 48 of the generator, the wear ring 60 and the top wall 32 of the casing are in axial alignment and form a passage for the water into the casing. In other words, the result is to provide a casing having an axially central opening in its top side for the axial passage of water into the pump casing, and this central passage is located at that side of the casing at which the shaft bearings are also located.

The bearing housing 7 is thus mounted on the pump casing top wall and in axial alignment with the impeller shaft 4. The generator 45, motor 1, housing 7, shaft 14 and impeller are rigidly, secured together as a unit, and detachably secured to the pump casing by bolts 55. O-ring 62 provides a fluid seal between the pump casing and the vortex generator.

By removing bolts 55, it is possible to remove the generator, motor 1 and the pump element 16 together as a unit, the impeller passing easily through the aligned central openings in the wear ring 60 and the plate 48. As mentioned, this permits easy and quick removal and replacement of any parts which become worn or damaged, such as the wear ring 60 or other elements. The seal 62 is automatically seated. Consequently, there is no critical alignment between the volute casing and the rotating elements. Adjustment of the impeller relative to the wear ring is easily accomplished outside of the pump casing. This eliminates the necessity of taking the various components apart, measuring the clearances, adding shims, gaskets or other adjusting devices to insure concentricity and proper alignment.

In operation, the water enters the vortex generator 45 and the vanes 49 and 50 are arranged so that the energy of the water is largely converted into rotary motion and is not consumed by eddy currents or other undesirable flow phenomenon which causes energy losses. In other words, the water flows between the fixed guide vanes which give the water the optimum direction of flow. The "preconditioned" flow of water then enters the central opening 40 in the pump casing and flows radially through the pump as the pump impeller 16 rotates and in cooperation with the cylindrical housing acts to discharge the water under pressure out the tangential conduit portion 34.

As shown in FIGS. 2 and 5, the flow of the water into the pump casing is in the form of a mass of rotating or whirling fluid that is sucked spirally into the center of the pump casing. This forms a whirlpool or a vortex and the zone 13 previously mentioned is substantially void of water and consequently there is substantially no water pressure in that zone. As a result, there is no water pressure tending to enter the bearing chamber 12, which results in the ability to use a rather simple and economical sealing arrangement in this area of the assembly. With the present invention, the lower part of the shaft 4 is thus located in the "eye" of the impeller and the bearing assembly is not located in the pump but instead outside of it and adjacent its central opening.

With the pump arrangement of the present invention, the water pressure is confined within the volute casing of the pump.

Furthermore, by having the inlet of the pump located above the pump rather than at its lower side as in prior art devices, the pump assembly in operation will not tend to bury itself in the water bed in which it is working. In other words, the pump of the present invention does not tend to suck itself down into the bed and bury itself.

Recapitulation

The present invention provides a submersible hydraulic pump assembly having a generally volute casing with an upper, centrally located water inlet that feeds water into the casing in an axial direction and for tangential discharge from the pump casing. The flow of water into the casing is from the same side of the casing on which the impeller shaft bearing is located. The water flow takes the form of a vortex and the bearing for the impeller shaft is located in this vortex which is substantially pressure free, thus not requiring any complex or expensive bearing means for the shaft.

The impeller, its bearing means, and its power source are quickly and easily removed from the pump casing. Service and replacement of any parts, and alignment between the various parts is quickly and easily accomplished.

I claim:

1. A submersible hydraulic pump assembly comprising a generally volute pump casing having two opposed sides, a fluid outlet extending generally tangentially from said pump casing, said casing having an axially central opening in one of said sides for the axial passage of water into said pump casing, a pump impeller located and rotatable in said casing and having a shaft fixed thereto and extending out of said casing through said central opening, a power source on said one of said sides of said pump casing and having a driving connection with said shaft for rotating said pump impeller to cause water to form as a vortex adjacent said one side and opening when said water flows into said central opening and thereby forms a central void of substantially no water pressure in said vortex, and bearing means for rotatably supporting said shaft, said bearing means mounted adjacent said one side and located outside of said casing and adjacent said central opening and in said void to prevent leakage of water into said bearing means.

2. The pump assembly set forth in claim 1 including a water vortex generator for preconditioning water prior to its entry into said central opening, said generator comprising a frame having an upper plate and a lower plate, a series of vertically arranged, circumferentially spaced apart vanes secured to and between said upper and lower plates, said lower plate being detachably secured to said pump casing, said lower plate of said generator having a central opening in alignment with said central opening of said pump casing, said power source and said bearing means being rigidly secured to said vortex generator for removal as a unit from said pump casing.

3. The pump assembly set forth in claim 2 including a wear ring secured to said lower plate of said generator and for sealing engagement with said pump casing.

4. A submersible hydraulic pump assembly comprising a generally volute pump casing having a closed bottom wall, and a top wall, a fluid outlet extending generally tangentially from said pump casing, said top wall having a central opening for the axial passage of water into said pump casing, a pump impeller mounted within said casing and having a shaft extending therefrom and through said opening in said top wall, a power source mounted above said pump casing and having a driving connection with said shaft for rotating said pump impeller, bearing means located outside of said casing and adjacent said central opening and for rotatably supporting said shaft, the action of the rotating impeller causing water to form as a vortex to flow into said central opening in said top wall and form a central void in said vortex and in the area of said bearing means to thereby create a zone of no pressure adjacent said bearing means.

5. The pump assembly set forth in claim 4, including a water vortex generator for preconditioning water prior to its entry into said central opening, said generator comprising a frame having an upper plate and a lower plate, a series of vertically arranged, circumferentially spaced apart vanes secured to and between said upper and lower plates, said lower plate being detachably secured to said pump casing, said lower plate of said generator having a central opening in alignment with said central opening of said pump casing, a bearing housing secured to said frame, said power source being secured to said bearing housing, said bearing means being mounted in said bearing housing, said vortex generator and said impeller being removable as a unit from said pump casing.

6. The pump assembly set forth in claim 5 including a wear ring secured to said lower plate of said generator and for sealing engagement with said pump casing.

7. A submersible hydraulic pump assembly comprising a generally volute pump casing having a closed flat bottom wall, a flat top wall, and a generally cylindrical side wall secured between said bottom and top walls, a fluid outlet extending generally tangentially from said pump casing, said top wall having a central opening for the axial passage of water into said pump casing, a pump impeller mounted within said casing and having a shaft extending therefrom and through said opening in said top wall, a bearing housing mounted on said casing top wall and in axial alignment with said shaft, a power source mounted on said bearing housing above said pump casing and having a driving connection with said shaft for rotating said pump impeller, bearing means located in said bearing housing and adjacent said central opening in said top wall and for rotatably supporting said shaft, the action of the rotating impeller causing water to form as a vortex to flow into said central opening in said top wall and form a central void in said vortex and in the area of said bearing means to thereby create a zone of no pressure adjacent said bearing means.

8. The pump assembly set forth in claim 7 including a water vortex generator for preconditioning water prior to its entry into said central opening, said generator comprising a frame having an upper plate and a lower plate, a series of vertically arranged, circumferentially spaced apart vanes secured to and between said upper and lower plates, said lower plate being detachably secured to said top wall of said pump casing, said lower plate of said generator having a central opening in alignment with said central opening of said pump casing, said bearing housing being mounted on said casing by being mounted on, said vortex generator, said power source, said bearing housing and said impeller being secured together for removal as a unit from said pump casing.

9. The pump assembly set forth in claim 8 including a wear ring secured to said lower plate of said generator and for sealing engagement with said pump casing.

* * * * *